United States Patent [19]

Saele

[11] Patent Number: 4,776,751

[45] Date of Patent: Oct. 11, 1988

[54] CROWD CONTROL SYSTEM FOR A LOADER

[75] Inventor: Arvid H. Saele, Peosta, Iowa

[73] Assignee: Deere & Company, Moline, Ill.

[21] Appl. No.: 87,072

[22] Filed: Aug. 19, 1987

[51] Int. Cl.[4] ..... B66C 23/00; B66F 9/00

[52] U.S. Cl. ..... 414/699; 414/697

[58] Field of Search ..... 414/685, 697, 699

[56] References Cited

U.S. PATENT DOCUMENTS

| | | | |
|---|---|---|---|
| 2,842,273 | 7/1958 | Granryd | 414/699 |
| 3,148,502 | 9/1964 | Granryd . | |
| 3,187,497 | 6/1965 | Granryd . | |
| 3,542,228 | 11/1970 | Horsch | 414/699 |
| 3,606,049 | 9/1971 | Gordon | 414/699 X |
| 3,653,523 | 4/1972 | Long et al. | 414/699 X |
| 3,749,269 | 7/1973 | Conrad . | |
| 3,792,791 | 2/1974 | Fleming et al. | 414/699 |
| 3,796,336 | 3/1974 | Ratliff | 414/699 |
| 3,905,501 | 9/1975 | Leroux . | |
| 4,165,613 | 8/1979 | Bernhoft et al. | 414/699 X |
| 4,248,137 | 2/1981 | Caruso . | |

FOREIGN PATENT DOCUMENTS

| | | | |
|---|---|---|---|
| 2440875 | 3/1975 | Fed. Rep. of Germany | 414/699 X |
| 55-66201 | 5/1980 | Japan | 414/699 X |

*Primary Examiner*—Robert J. Spar
*Assistant Examiner*—Jennifer L. Doyle

[57] ABSTRACT

A crowd control system for a hydraulic loader having three hydraulic pressure sensing switches that are electrically coupled to an electronic controller for overriding the operators commands and decreasing forward driving force when excessive crowding force is detected. The first switch is fluidically coupled to the output side of the hydraulic lifting pump. The second switch is fluidically coupled to the output side of the hydraulic lifting pump. The third switch is fluidically coupled to the extension input side of the boom-lift hydraulic actuator. When hydraulic fluid pressure exceeds the preset levels of each switch, the switches signal the electronic controller which overrides the operators controls and decreases the fluid output of the driving pump reducing the forward drive of the loader and decreasing crowd. The controller will maintain this decreased fluid output of the driving pump until either the second or third pressure sensing switch senses a decrease in fluid pressure below its preset level.

14 Claims, 4 Drawing Sheets

FIG. 1
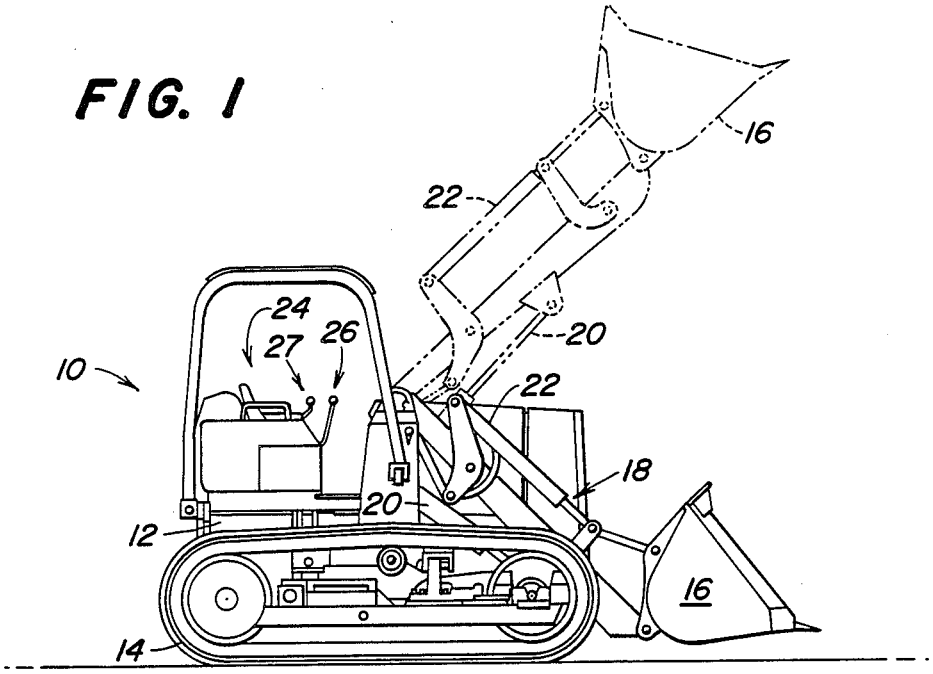
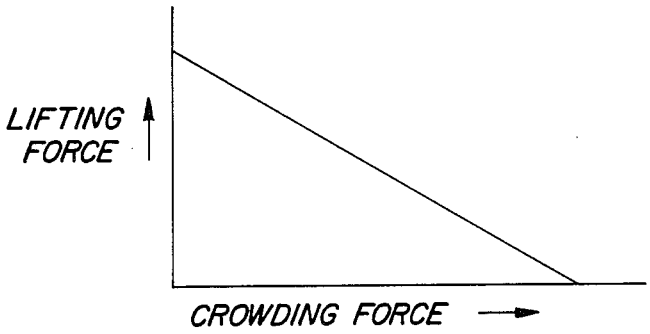
FIG. 2

CROWD CONTROL SYSTEM FOR A LOADER

BACKGROUND OF THE INVENTION

1. Field of the Invention

The invention is directed to a system for controlling crowd when loading a hydrostatic loader. More specifically, an electronic controller and three pressure sensing switches are used to modify hydrostatic transmission output to reduce crowd when the loader approaches a stall condition.

2. Description of the Prior Art

Loaders are used to lift and move bulk materials. The loader comprises a self-propelled vehicle having a front mounted bucket and associated hydraulic lifting means for lifting the bulk material holding bucket. Such loaders may be provided with endless tracks of wheels to provide tractive force. Typically, the operator will drive the bucket into the bulk material and tilt and lift the bucket to shear the material away from the pile. The operator will then dump his load where desired and repeat the process as necessary.

During the loading operation, the loader develops two basic forces, a horizontal crowd force and a vertical lifting force. The crowd force is the reaction which results from the vehicle driving the bucket horizontally into the pile of material, whereas the lifting force is the reaction to the force required to lift the material from the pile. It is desirable to limit crowd reaction force such that significant lifting force remains.

Typically, loaders have been equipped with open center hydraulic systems. Such loaders have been designed to give priority for power to the hydraulic lifting means at the expense of the drive assembly. Since the bucket is close to a stall condition when digging, the power going to the hydraulic lifting means is absorbed as heat in the hydraulic system.

With energy efficient hydraulic systems, that is, power on demand hydraulic systems, the ability of loaders to relax crowd by consuming power thermally, is lost. Therefore, power not being consumed hydraulically would go the drive assembly resulting in increased crowd or excessive track spin if traction with the ground has been broken.

The object of the present invention is to provide a crowd control system for a loader using a hydrostatic transmission and a power on demand hydraulic system.

SUMMARY OF THE INVENTION

The present crowd control system is directed to a loader having a hydrostatic transmission with a variable displacement reversible hydraulic driving pump and a reversible driving motor for driving the loader. The hydraulic boom lifting actuator is powered by a variable displacement pump, the output of which is pumped through a three-position four-way directional control valve. The output of the variable displacement driving pump is controlled by an operator control lever which is electrically coupled to an electronic controller. The electronic controller is coupled to three hydraulic pressure sensing switches and overrides the operator's control signals to the variable displacement driving pump when the loader is approaching a stall condition.

The three hydraulic pressure sensors are normally open hydraulic pressure switches that close when sensed hydraulic pressure exceeds the preset limit of each switch. The switches provide an overpressure input signal to the electronic controller. The first pressure sensor switch is coupled to the forward output side of the driving pump and detects the hydraulic pressure when driving the loader forward. The second pressure sensor switch is coupled to the output side of the hydraulic actuator pump for detecting hydraulic output pressure of this pump. The third pressure sensor switch is coupled to the input extension side of the hydraulic actuator for detecting hydraulic pressure during the extension of the actuator causing lifting of the boom.

The electronic controller comprises a microprocessor that is electrically coupled to the three hydraulic pressure switches. When the hydraulic pressure in the three hydraulic lines exceeds the preset limit of the switches, the microprocessor through associated driving circuits repositions the swash plate of the variable displacement driving pump reducing its output to a predetermined level. Reducing the output of the driving pump reduces the crowd reaction force, this enables the lifting force to overcome the bulk material and break the bulk material containing bucket free from the pile. If the hydraulic pressure asserted against either the second or third pressure sensing switch has decreased below the preset limit, the microporcessor, through the driving circuits, releases its override control of the variable displacement driving pump and returns control to the operator.

BRIEF DESCRIPTION OF THE DRAWINGS

FIG. 1 is a side view of a crawler loader.

FIG. 2 is a graphical illustration of the crowd versus lift diagram for loaders.

DETAILED DESCRIPTION

Figure 3:
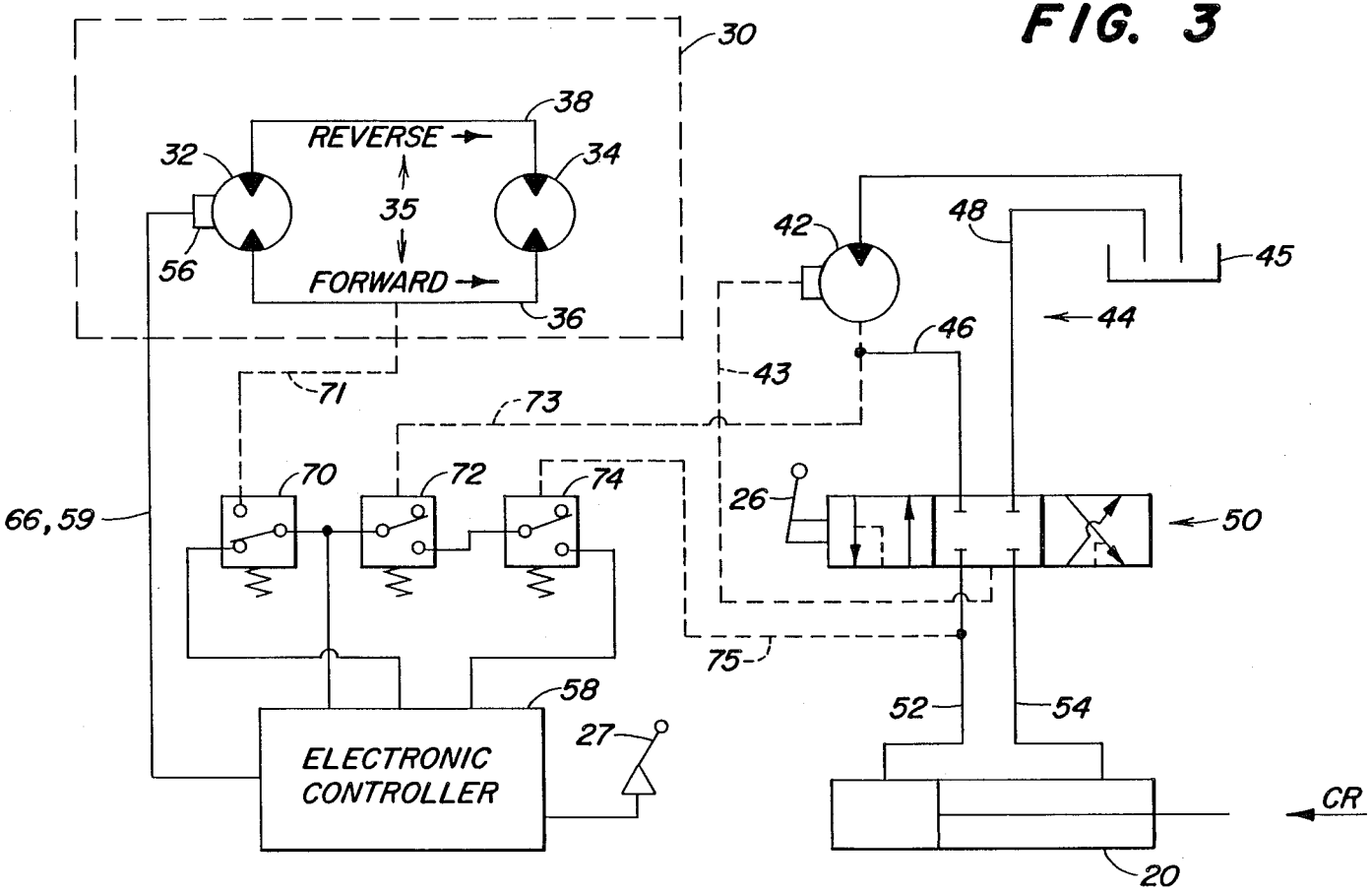
FIG. 3 is a hydraulic schematic of the present invention.

Loader 10, illustrated in FIG. 1, comprises a supporting structure 12 which is provided with ground engaging tracks 14 and movable bucket 16. The bucket is operatively coupled to the supporting structure of the loader by linkage assembly 18. The linkage assembly is actuated by boom-lift hydraulic actuator 20 and bucket tilt actuator 22. The operation of the loader is controlled by an operator working at operator station 24. The operator manipulates various control levers 26 and 27 to drive the loader and to control the movement of the bucket. Control lever 26 is operatively coupled to control valve 50 for controlling the movement of boom-lift hydraulic actuator 20. Control lever 27 is used to control the output of hydrostatic drive system 30 by controlling the hydraulic output of pump 32. It should be noted that although the loader is illustrated as having only one boom-lift actuator and one bucket tilt actuator, duplicate actuators are located on the other side of the loader.

When digging, the bucket is lowered and driven into a pile of bulk material by the forward movement of the loader. The operator simultaneously manipulates the boom-lift actuator to lift the bucket, breaking the bulk material free from the pile. As discussed above, as crowd reaction increases lifting force decreases. Such a relationship is graphically displayed by the downwardly sloping line of the crowd versus lift diagram illustrated in FIG. 2.

Figure 4:
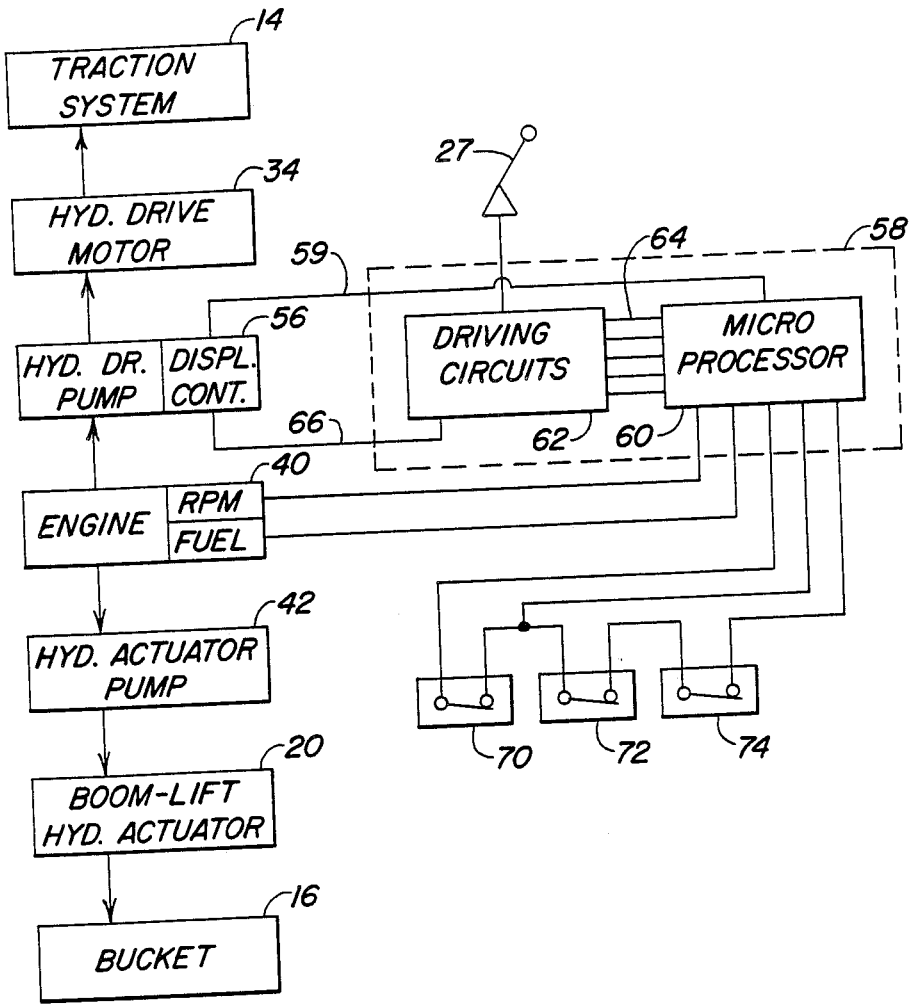
FIG. 4 is an electrical schematic of the present invention.

FIGS. 3 and 4 illustrate the operational schematics of the hydraulic system and electrical system for the loader. The loader is driven by a power on demand hydrostatic drive system 30 comprising reversible variable displacement pump 32 and reversible hydraulic motor 34. Hydraulic fluid from the pump is transmitted to the motor through hydraulic driving circuit 35 comprising forward driving hydraulic line 26 and reverse driving hydraulic line 38. Pump 32 is operatively coupled to prime mover 40 which typically comprises an internal combustion engine.

The vehicle is provided with a lifting means comprising boom-lift actuator 20 which is actuated by variable displacement pump 42. Pump 42 is provided with a hydraulic fluid pressure sensing line 43 which acts as a feed back loop for controlling the output of variable displacement pump 42. Pump 42 is operatively coupled to prime mover 40 and is fluidically coupled to actuator 20 by hydraulic actuator circuit 44. Hydraulic fluid is withdrawn from pump 45 by pump 42 and directed through forward hydraulic line 46 to control valve 50. Control valve 50 is a three-position four-way directional control valve which is used to control the operation of actuator 20. Hydraulic fluid is either directed through extension hydraulic line 52 or retraction hydraulic line 54 by the control valve. Hydraulic fluid is exhausted from control valve 50 through line 48.

The output of pump 32 is controlled by displacement and direction controller 56 which controls the positioning of the swash plate of pump 32. Controller 56 is electrically coupled through electronic controller 58 to the operator's control lever 27. The operator by manipulating the control lever controls the direction and speed of the loader's movements. Controller 56 is also provided with a feedback mechanism similar to that disclosed in U.S. Pat. No. 4,248,137, and marketed by Moog, Inc., for providing an electrical signal indicating the position of the swash plate. The electrical feedback signal is transmitted along electrical line 59 to the electronic controller 58.

Electronic controller 58 can override the operator's controls and reduce crowd during a digging operation. Controller 58 comprises microprocessor 60 and driving circuits 62. In response to a signal from electronic controller 58 through electrical lines 64, the driving circuits directs a signal through electrical line 66 to direction and displacement controller 56 for positioning the swash plate of the driving pump. Normally, the control signal is in direct response to the operator positioning control lever 27, however, electronic controller 58 may override the operator's positioning signal and directly control the positioning of the swash plate when the loader is approaching a stall condition.

First, second and third hydraulic pressure sensing switches 70, 72 and 74 form a sensing means for sensing hydraulic pressure in the various hydraulic circuits. First pressure sensing switch 70 is fluidically coupled to forward hydraulic line 36 through sensing line 71, for detecting if the hydraulic pressure in line 36 exceeds a preset pressure level. Switch 70 is normally opened and when it is closed by the hydraulic pressure in line 36 exceeding a preset amount, the loader is driving forward with a high hydraulic pressure load. Second, pressure sensing switch 72 is fluidically coupled to forward hydraulic line 46, through sensing line 73, for sensing the output hydraulic pressure of pump 42. The third pressure sensing switch 74 is electrically connected in series with switch 72 and is fluidically coupled to extension hydraulic line 52, through sensing line 75, for measuring the hydraulic pressure in this line. As the boom-lift actuator is extended, the reaction force of the material being lifted and the crowd reaction force CR acts on the lift actuator creating an increase in hydraulic pressure in the actuator hydraulic circuit which is greater than the preset limit of switches 72 and 74.

When switches 70, 72, and 74 are closed, electronic controller 58 overrides the operator positioning signal reducing the hydraulic output of pump 32. As the output of the driving pump 32 is reduced, first switch 70 opens because of the reduced hydraulic pressure in forward line 26. However, the reduced output of the driving pump is maintained until either the second or third pressure sensing switch 72 and 74 is opened indicating a reduction in hydraulic pressure in either line 46 or 52. When this condition occurs, electronic controller 58 returns control to the operator. As the opened and closed condition of the second and third pressure sensing switches is an either/or condition these switches are electrically coupled in series whereas the first switch is electrically coupled in parallel.

To prevent inappropriate triggering of the crowd control system, two pressure sensing switches are provided, second and third switches 72 and 74. At times, it is desirable to use the bucket as a pushing implement. Such an operation results in a large crowd reaction acting on boom-lift hydraulic actuator 20 increasing hydraulic pressure in the actuator and closing switch 74. However, because a boom-lift actuator is not being manipulated, pump 42 has minimal hydrualic output and as such switch 72 remains open so the crowd control system is not triggered.

It should be noted that three pressure transducers may be substituted for pressure sensing switches 70, 72 and 74. In such a sensing system, the transducers would provide a continuous pressure signal, rather than the two-level signal provided by the switches. With pressure transducers, the microprocessor would need to be programmed to interpret the pressure signals from the transducers and determine when an overpressure situation exists in each of the monitored hydraulic circuits.

Figure 5:
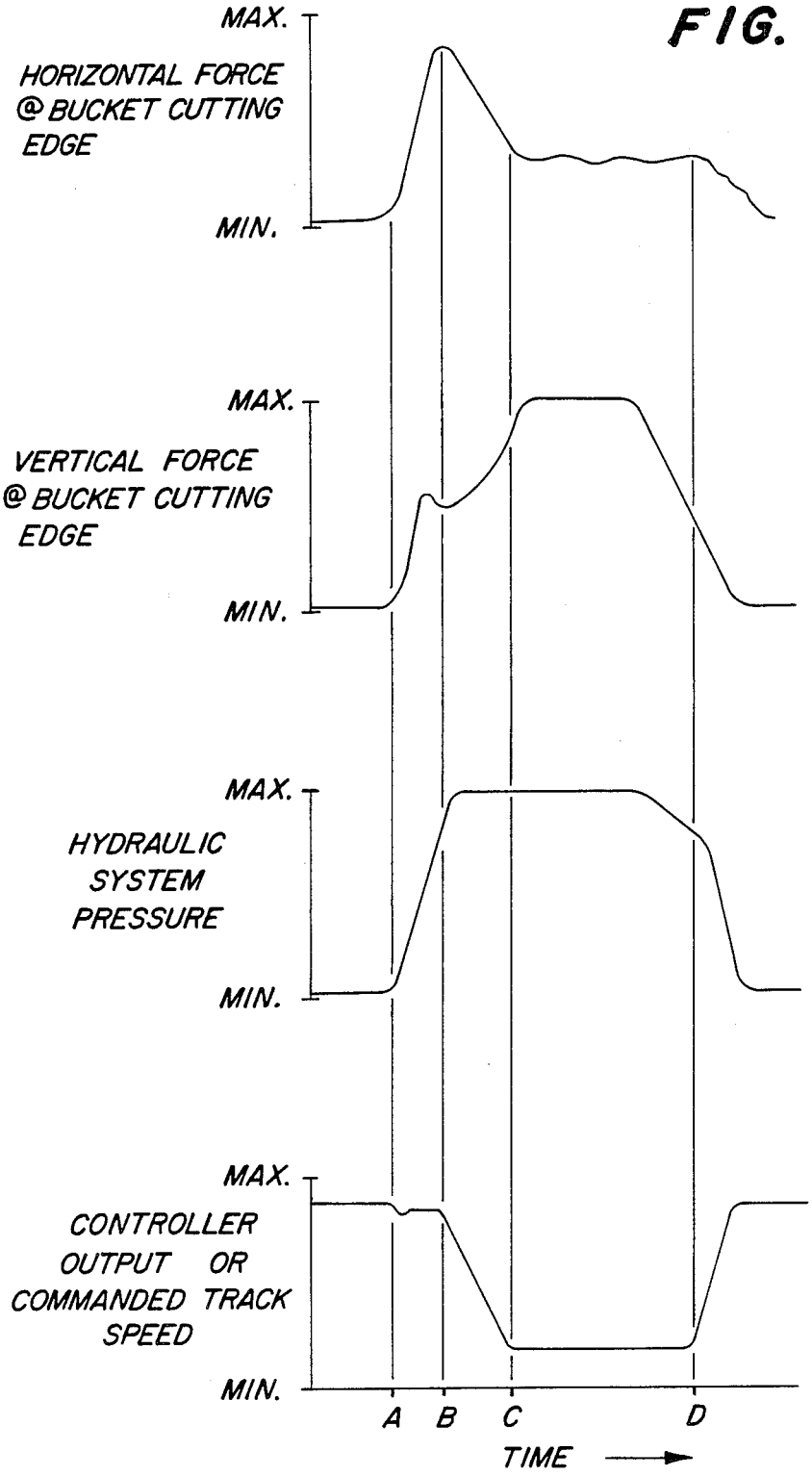
FIG. 5 is a graphical illustration of the various parameters during loader operations.

The overall operation of the system is best described in conjunction with FIG. 5. The top two graphs in FIG. 5 illustrate the horizontal and vertical force acting on the loader as it attempts to lift bulk material. More specifically, time "A" is the start of the loading cycle wherein the bucket begins penetrating the bulk material and the boom-lift cylinder is actuated to lift the load as the bucket is being driven into the material. Shortly before time "B", horizontal force is increasing and vertical lifting force is starting to decrease because of increased crowding force. Time "B" is a near stall condition wherein there is a high horizontal force and diminishing vertical force acting on the bucket and the maximum system hydraulic pressure, as indicated by the third graph has almost been reached. This increase of hydraulic pressure in hydraulic lines 36, 46 and 52 results in pressure sensing switches 70, 72 and 74 closing. At this point, the output of the variable displacement driving pump 32 is reduced by electronic controller 58, as indicated by the bottom graph. By time "C", the output of pump 32 has been reduced, resulting in a decrease in horizontal force and an increase in vertical lifting force. As the bulk material is sheared away during the lifting operation, the hydraulic pressure in either or both line 46 or 52 lessens, resulting in an opening of either or both switch 72 or 74 at time "D". At this time, the electronic controller 58 releases control of pump 32 to the operator.

This invention should not be limited by the above-described embodiment, but should be limited solely by the claims that follow.

I claim:

1. A self-propelled hydraulic loader, said loader comprising:

a self-propelled vehicle having round engaging members that are operatively coupled to a drive system for driving the ground engaging members and propelling the vehicle across the ground, the drive system comprising a variable output hydraulic driving pump and a hydraulic driving motor which are fluidically coupled to one another by a hydraulic driving circuit;

a bucket in which material is loaded, the bucket being coupled to the vehicle by a linkage assembly, the bucket being provided with lifting means for lifting the bucket through its linkage assembly, the lifting means comprising a hydraulic actuator pump and a hydraulic actuator which are fluidically coupled to one another through a hydraulic lifting circuit, a control valve being positioned between the hydraulic actuator pump and the actuator for controlling the flow of fluid to and from the actuator; and control means for controlling the output of the hydraulic drive system by regulating the hydraulic driving pump, the control means being provided with sensing means for sensing the hydraulic pressure in the hydraulic driving circuit and the hydraulic lifting circuit, the control means comprising an electronic controller which is electrically coupled to the sensing means, the sensing means comprising first, second and third electrical pressure sensing switches, the first pressure sensing switch is coupled to the forward hydraulic line of the driving hydraulic circuit for detecting hydraulic pressure in the forward hydraulic line indicating forward movement of the vehicle, the second pressure sensing switch is fluidically coupled to the hydraulic lifting circuit between the control valve and the hydraulic actuator pump for detecting hydraulic output pressure of the pump, and the third pressure sensing switch is fluidically coupled to the hydraulic lifting circuit between the control valve and the hydraulic actuator for detecting the hydraulic extension pressure of the hydraulic actuator, the sensing means providing signals of hydraulic pressure in each of these circuits to the control means which in response thereto decreases fluid output of the hydraulic driving pump when pressure in the hydraulic lifting circuit has increased above a predetermined level, the control means maintaining decreased fluid output of the hydraulic driving pump until the pressure in the hydraulic lifting circuit has decreased below a predetermined level at either the second of third electrical pressure sensing switch.

2. A loader as defined in claim 1 wherein the hydraulic driving pump is a variable displacement reversible pump and the hydraulic driving motor is a reversible motor, the hydraulic driving circuit between the hydraulic driving pump and the hydraulic driving motor comprises a forward hydraulic line in which fluid is directed from the pump to the motor for driving the vehicle in the forward direction and a reverse hydraulic line in which fluid is directed from the pump to the motor for driving the vehicle in the reverse direction.

3. A loader as defined by claim 2 wherein the hydraulic actuator pump is a variable displacement pump.

4. A loader as defined by claim 3 wherein the control valve comprises a directional control valve for controlling the direction of fluid flow from the hydraulic actuator pump to the hydraulic actuator.

5. A loader as defined in claim 4 further comprising operator controls for controlling fluid output of the hydraulic driving pump, the operator controls are electrically coupled to the electronic controller and normally control fluid output of the hydraulic driving pump when the electronic controller overrides the operator controls when fluid pressures sensed by the first, second and third pressure sensing switches exceed predetermined pressures.

6. A crowd control system for a self-propelled hydraulic loader, the loader having a drive system that is provided with a variable output hydraulic driving pump and hydraulic driving motor which are fulidically coupled to one another by a hydraulic driving circuit, a bucket for lifting bulk material, the bucket being coupled to the loader by a linkage having a lifting means that is provided with a hydraulic actuator pump and a hydraulic actuator that are fluidically coupled to one another by a hydraulic lifting circuit, a control valve being positioned between the actuator pump and the actuator for controlling the flow of fluid to the actuator from the pump, the crowd control system comprising:

control means for controlling the output of the hydraulic drive system by regulating the hydraulic driving pump, the control means being provided with sensing means for sensing the hydraulic pressure in the hydraulic lifting circuit, the sensing means being provided with at least two sensors, one sensor sensing hydraulic pressure between the actuator pump and the control valve and the second sensor sensing hydraulic pressure between the control valve and the actuator, the sensing means providing signals of pressure in the lifting circuit to the control means which in response thereto decreases fluid output of the hydraulic driving pump when pressure in the hydraulic lifting circuit has increased above a predetermined level, the control means maintaining decreased fluid output of the hydraulic driving pump until the pressure in the hydraulic lifting circuit has decreased below a predetermined level.

7. A crowd control system as defined by claim 6 wherein the hydraulic driving pump is a variable displacement reversible pump and the hydraulic driving motor is a reversible motor, the hydraulic driving circuit between the hydraulic driving pump and the hydraulic driving motor comprising a forward hydraulic line in which fluid is directed from the pump to the motor for driving the vehicle in the forward direction and a reverse hydraulic line in which fluid is directed from the pump to the motor for driving the vehicle in the reverse direction.

8. A crowd control system as defined by claim 7 wherein the hydraulic actuator pump is a variable displacement pump.

9. A crowd control system as defined by claim 8 wherein the control valve being a directional control valve for controlling the direction of fluid from the hydraulic actuator pump to the hydraulic actuator.

10. A crowd control system as defined by claim 9 wherein the control means comprises an electronic controller which is electrically coupled to the sensing means, the sensing means comprising a first electrical pressure sensing switch, the first pressure sensing switch is coupled to the forward hydraulic line of the driving hydraulic circuit for detecting hydraulic pressure in the forward hydraulic line indicating forward movement of the vehicle, the first sensor of the sensing means comprising a second pressure sensing switch, and the second sensor of the sensing means comprising a third pressure sensing switch.

11. A loader as defined by claim 10 further comprising operator controls for controlling fluid output of the hydraulic driving pump, the operator controls being electrically coupled to the electronic controller and normally control fluid output of the hydraulic driving pump except when the electronic controller overrides the operator controls when fluid pressures sensed by the first, second and third pressure sensing switches exceed predetermined pressures.

12. A method of controlling working tool stall in a hydrostatic power on demand self-propelled loader during a loading operation, the method comprising the following steps:

sensing hydraulic pressure in the loader's hydraulic driving circuit;

detecting hydraulic pressure between a control valve and a hydraulic actuator pump in the hydraulic lifting circuit;

detecting hydraulic pressure in an extension line between the control valve and a hydraulic actuator in the hydraulic lifting circuit;

overriding operator driving controls of the loader when the sensed hydraulic pressure in the hydraulic driving circuit and the both detected hydraulic pressures in the hydraulic lifting circuit exceed a predetermined amount; and reducing hydraulic output through the hydraulic driving circuit when the sensed hydraulic pressure in both the hydraulic lifting circuit and the hydraulic driving circuit exceed the predetermined amount.

13. A method according to claim 12 comprising the additional step of releasing the overridden operator controls when the pressure in the hydraulic lifting circuit is below the predetermined amount.

14. A method according to claim 13 comprising the additional step of signaling an electronic controller when the sensed hydraulic pressure in both the hydraulic driving circuit and the hydraulic lifting circuit exceeds the predetermined amount.

* * * * *

UNITED STATES PATENT AND TRADEMARK OFFICE

CERTIFICATE OF CORRECTION

PATENT NO. : 4,776,751

DATED : October 11, 1988

INVENTOR(S) : Arvid H. Saele

It is certified that error appears in the above-identified patent and that said Letters Patent is hereby corrected as shown below:

Column 5, line 9, after "having" insert -- ground --;
line 59, delete "of" and insert therefor -- or --;

Column 6, line 14, after "pump" insert -- except --;
line 21, delete "fulidically" and insert therefor -- fluidically --;
line 67, after "fluid" insert -- flow --.

Signed and Sealed this

Fifth Day of September, 1989

*Attest:*

*Attesting Officer*

DONALD J. QUIGG

*Commissioner of Patents and Trademarks*